US008132813B2

(12) United States Patent
Wilkinson et al.

(10) Patent No.: US 8,132,813 B2
(45) Date of Patent: Mar. 13, 2012

(54) MAGNETIC SPINNER

(75) Inventors: Riley Wilkinson, Long Beach, CA (US); Damon R. Saddler, Inglewood, CA (US)

(73) Assignee: Educational Insights, Inc., Gardena, CA (US)

( * ) Notice: Subject to any disclaimer, the term of this patent is extended or adjusted under 35 U.S.C. 154(b) by 0 days.

(21) Appl. No.: 12/821,952

(22) Filed: Jun. 23, 2010

(65) Prior Publication Data

US 2010/0320683 A1 Dec. 23, 2010

Related U.S. Application Data

(60) Provisional application No. 61/219,676, filed on Jun. 23, 2009.

(51) Int. Cl.
*A63F 5/04* (2006.01)

(52) U.S. Cl. ..... 273/141 A; 273/141 R; D21/374

(58) Field of Classification Search ..... 273/141 R, 273/141 A; D21/374
See application file for complete search history.

(56) References Cited

U.S. PATENT DOCUMENTS

| | | | | |
|---|---|---|---|---|
| 2,933,827 | A * | 4/1960 | Alberts | 434/433 |
| 4,243,223 | A * | 1/1981 | Ver Hoef et al. | 273/141 R |
| 5,217,225 | A * | 6/1993 | Dubarry, Jr. | 273/141 R |
| 6,059,290 | A * | 5/2000 | Neil | 273/243 |
| 2004/0047052 | A1 * | 3/2004 | Zadro | 359/855 |

* cited by examiner

*Primary Examiner* — Benjamin Layno
(74) *Attorney, Agent, or Firm* — Michael Best & Friedrich LLP

(57) ABSTRACT

A spinner anchors to a variety of magnetic and non-magnetic surfaces. The spinner includes a base, a spinner arm rotatably coupled to the base, and an indicator coupled to the spinner arm. The base of the spinner is shaped to receive a coupling member, such as a cylindrical magnet, configured to anchor the spinner to a plurality of surfaces regardless of their orientation and maintain its location relative to the support surface while the spinner arm and indicator rotate.

17 Claims, 12 Drawing Sheets

MAGNETIC SPINNER

CROSS-REFERENCE TO RELATED APPLICATION

This application claims the benefit of and priority to U.S. Provisional Patent Application No. 61/219,676 filed Jun. 23, 2009, the entire contents of which are hereby incorporated by reference.

FIELD OF THE INVENTION

The present invention relates to a multi-purpose spinner typically used for games, and more specifically to a magnetically supported spinner.

BACKGROUND

Educators frequently search for more exciting and captivating ways to teach children. Often times, teachers utilize a whiteboard to display visual aids and important information related to the lesson. A major drawback to this teaching style is that it can often be seen as dull, losing the children's attention and resulting in important information being missed. The whiteboard is not easily used for games and/or examples which require motion or impartial selection techniques. This limits the use of whiteboards for activities where the students can participate during class.

In addition, educators must regularly choose random numbers, students, colors, and the like for teaching activities, games, and so forth. It is often important that random selection technique be used in a classroom so that each child feels that he/she has an equal chance at being selected or that a number, color, or other object or activity has been randomly selected for a particular student.

SUMMARY

The present invention relates generally to a spinner couplable to a support surface. The spinner comprises a base defining a central axis, a spinner arm coupled to and rotatable with respect to the base about the central axis, and a coupling member to removably couple the base to the support surface. The coupling member sufficient to maintain the location of the base on the support surface regardless of the orientation of the central axis or the rotation of the spinner arm.

In one embodiment, the spinner may include a base defining a central axis, a coupling member to removably couple the base and the support surface, a spinner arm coupled to and rotatable with respect to the base about the central axis, the spinner arm including a first alignment mechanism, and an indicator couplable to the spinner arm and defining a center of mass. The indicator includes a second alignment mechanism engageable with the first alignment mechanism to position the indicator on the spinner arm such that the center of mass of the indicator when coupled to the spinner arm is substantially co-axial with the central axis.

In another embodiment, the spinner may include a base defining a central axis, a spinner arm coupled to and rotatable with respect to the base about the central axis, a coupling member to removably couple the base to the support surface, the coupling member sufficient to maintain the location of the base on the support surface regardless of the orientation of the central axis, and an indicator couplable to the spinner arm and defining a center of mass. The indicator coupled to the spinner arm such that the center of mass is substantially co-axial with the central axis.

Figure 1:
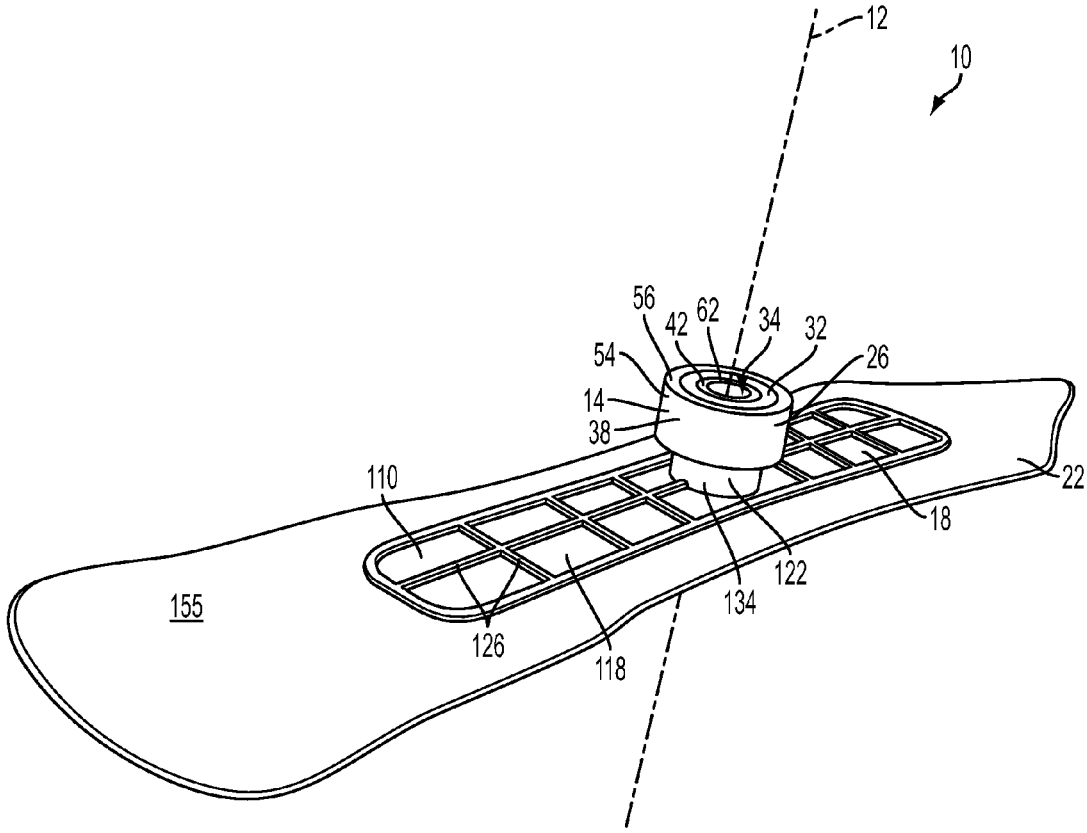
FIG. 1 is a bottom perspective view of a spinner.
Figure 2:
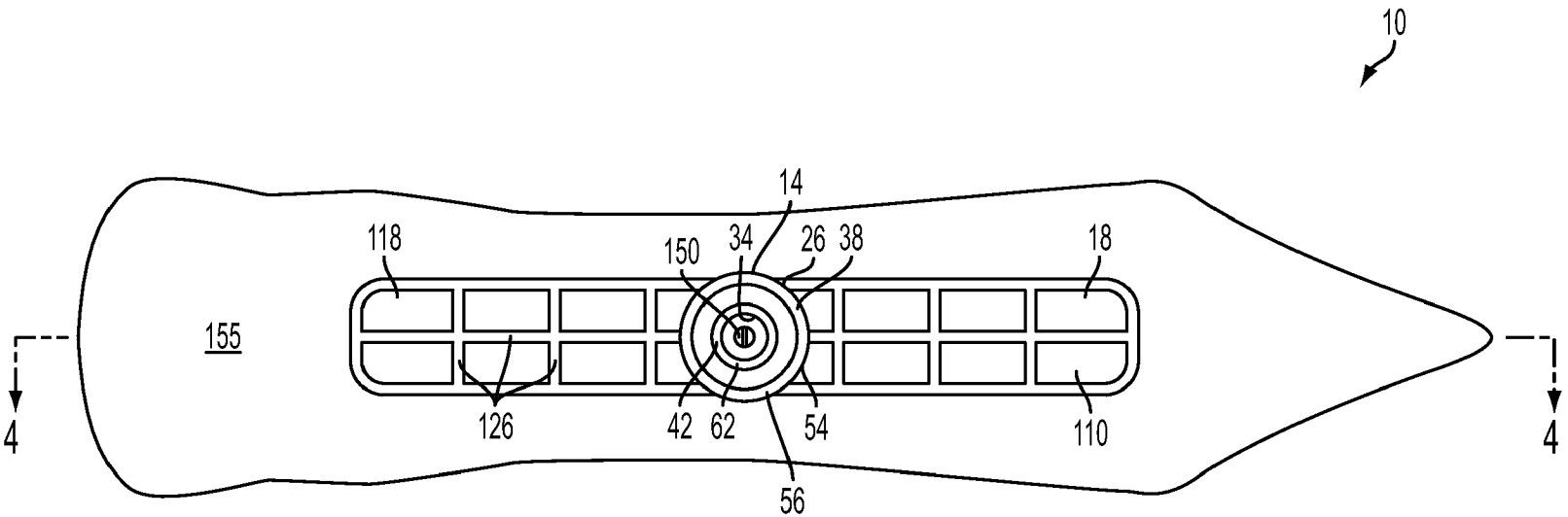
FIG. 2 is a bottom view of the spinner of FIG. 1.
Figure 3:
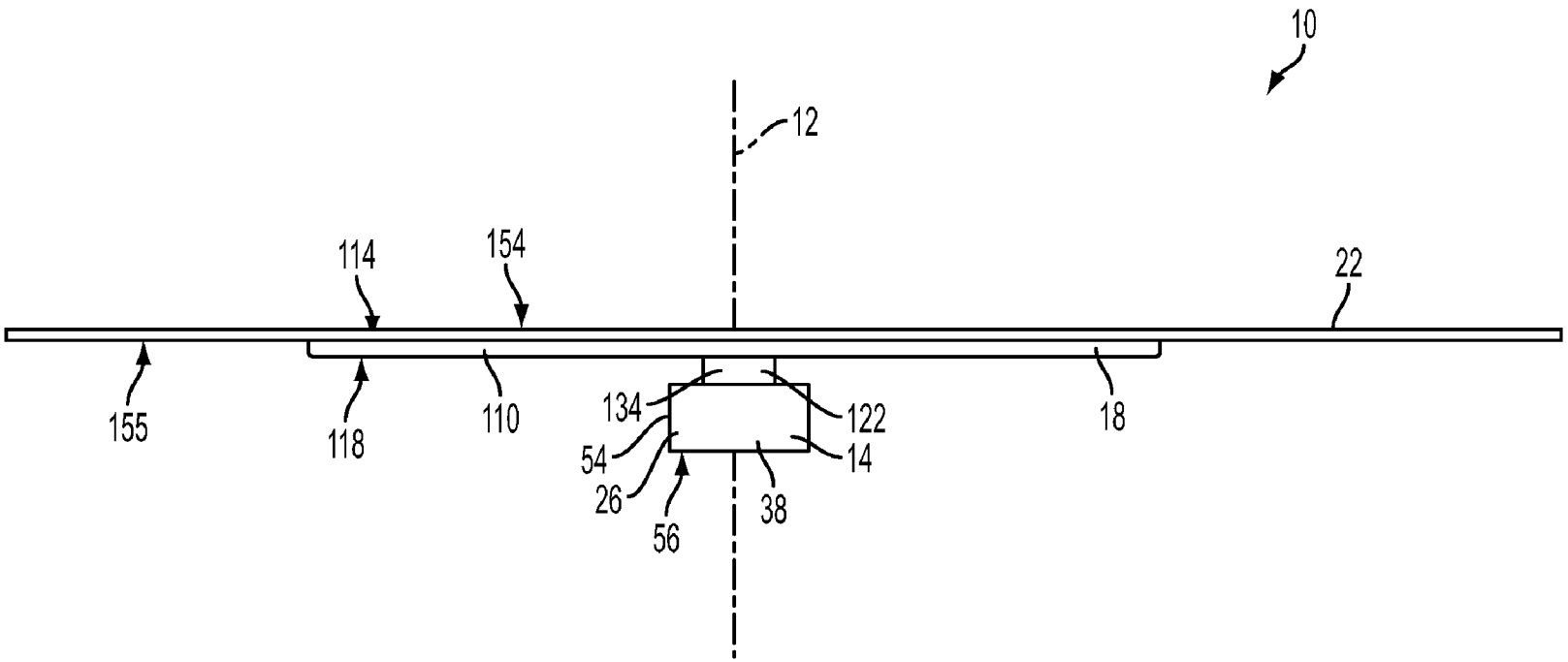
FIG. 3 is a side view of the spinner of FIG. 1.
Figure 4:
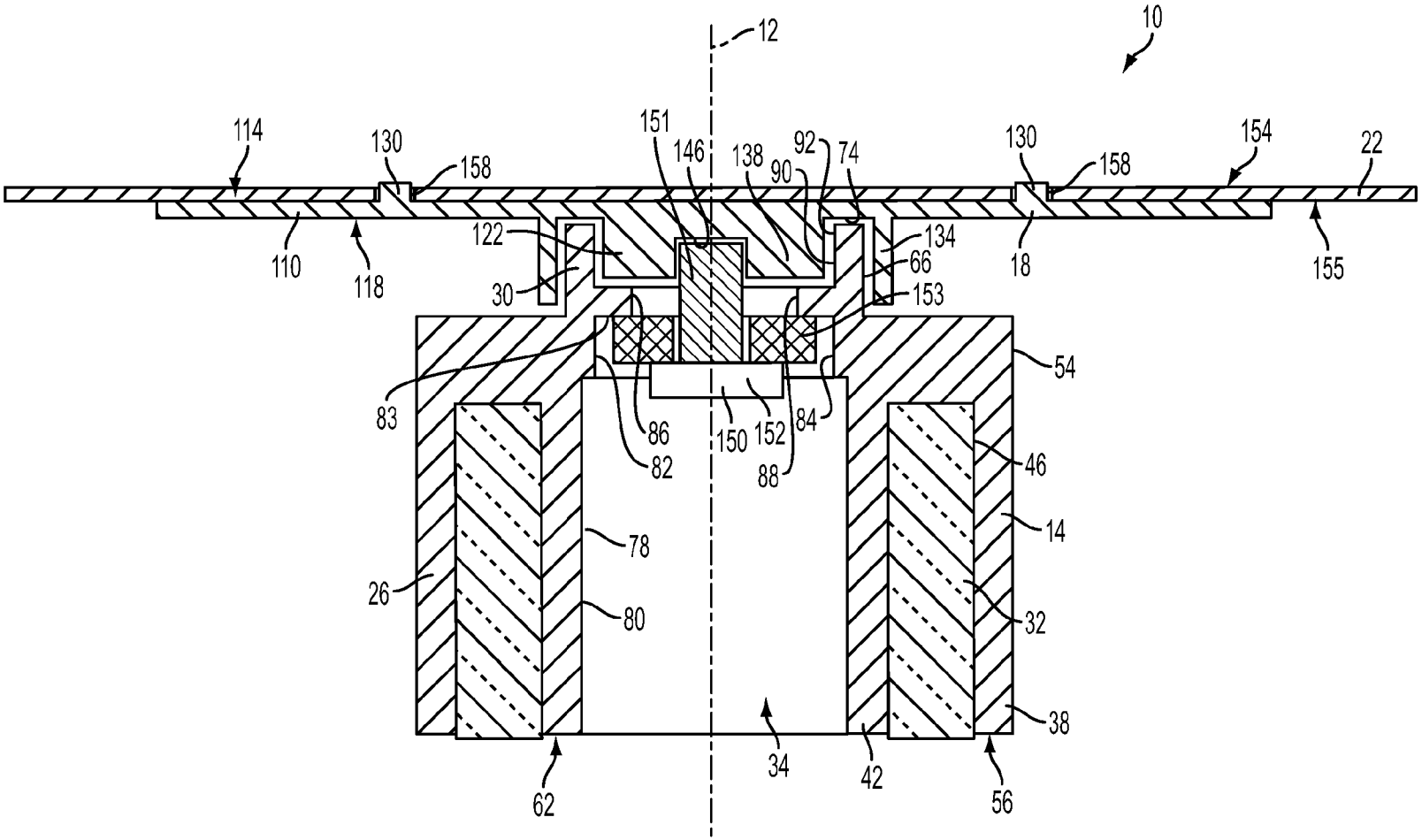
FIG. 4 is a section view of the spinner taken along line 4-4 of FIG. 2.
Figure 5:
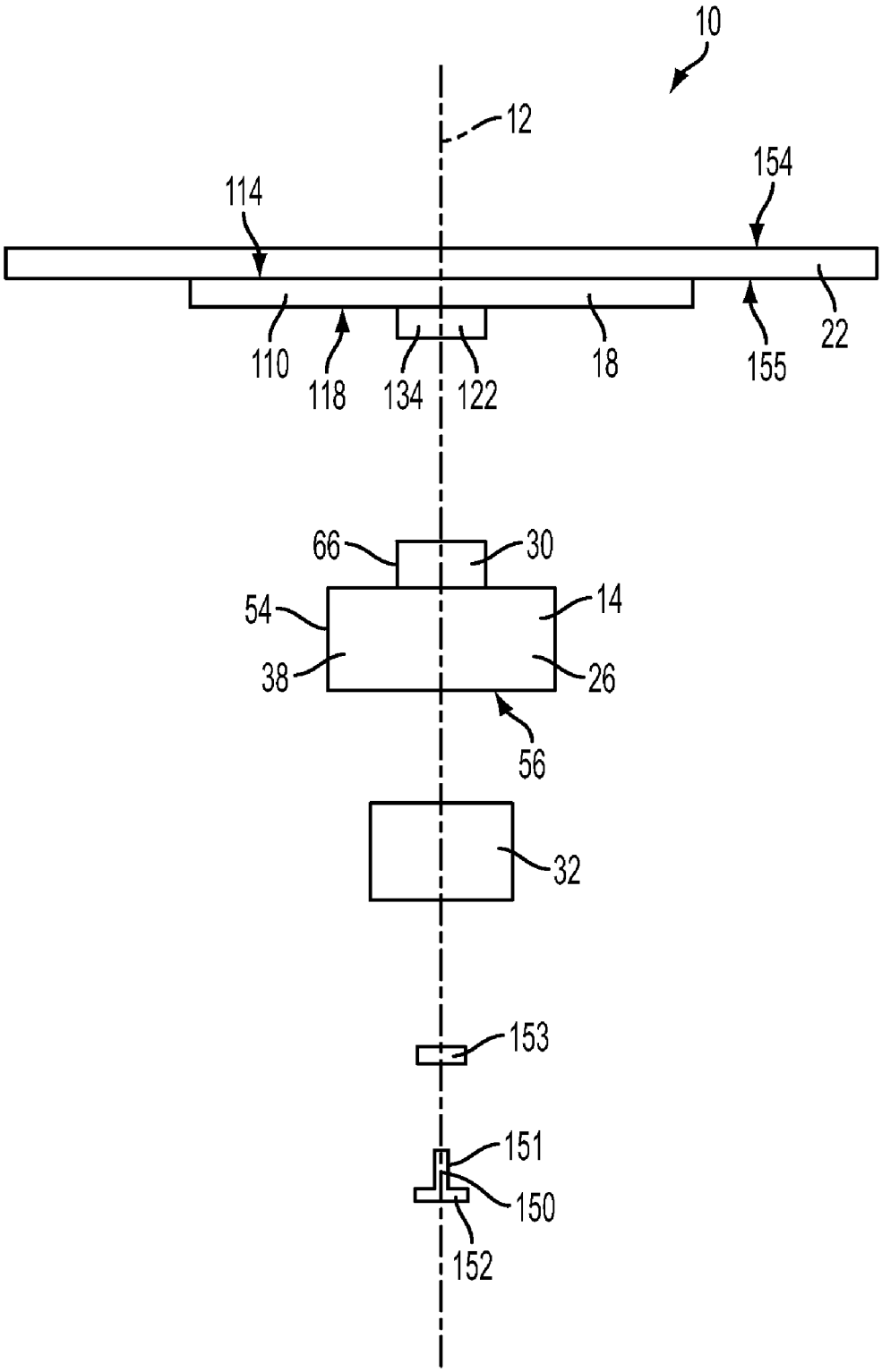
FIG. 5 is an exploded side view of the spinner of FIG. 1.

It is to be understood that the invention is not limited in its application to the details of construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

FIGS. 1-5 illustrate a multi-purpose spinner 10 anchorable to various support surfaces. More specifically, the spinner 10 may be removeably coupled to a whiteboard, a blackboard, a wall, a desk and the like. The spinner 10 generally defines a central axis 12 and includes a base 14, a spinner arm 18 rotatably coupled to the base 14, and an indicator 22 coupled to the spinner arm 18. During use, the base 14 of the spinner 10 is removeably coupled to a support surface (e.g., a whiteboard) and the spinner arm 18 is rotatably biased about the axis 12 with respect to the base 14. In some specific uses, the spinner 10 may be placed at the center of a pie chart, multiple pictures, people, and the like displayed on the support surface, whereby the spinner may be rotated to impartially select between one of the pie sections, pictures, people, or objects.

Figure 8:
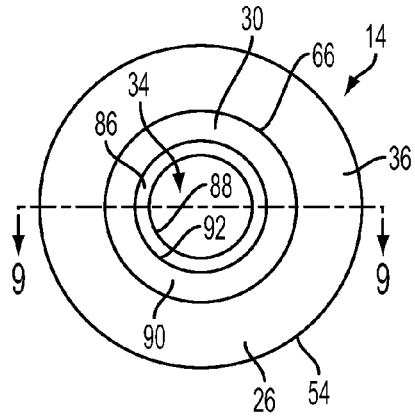
FIG. 8 is a top view of a base of the spinner of FIG. 1.
Figure 9:
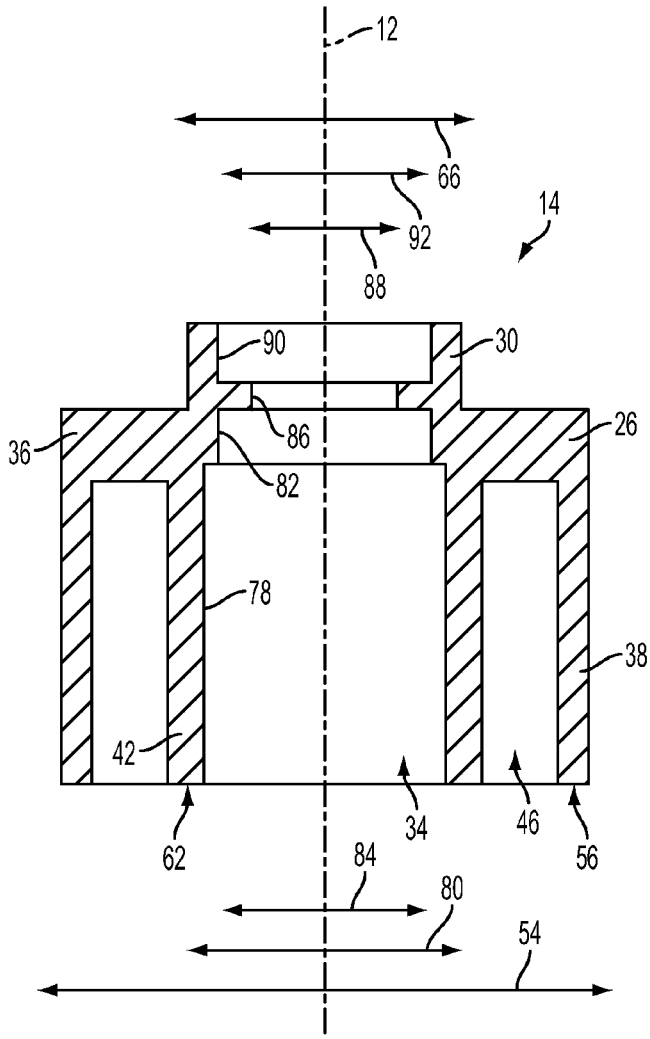
FIG. 9 is a section view taken along line 9-9 of FIG. 8.
Figure 10A:
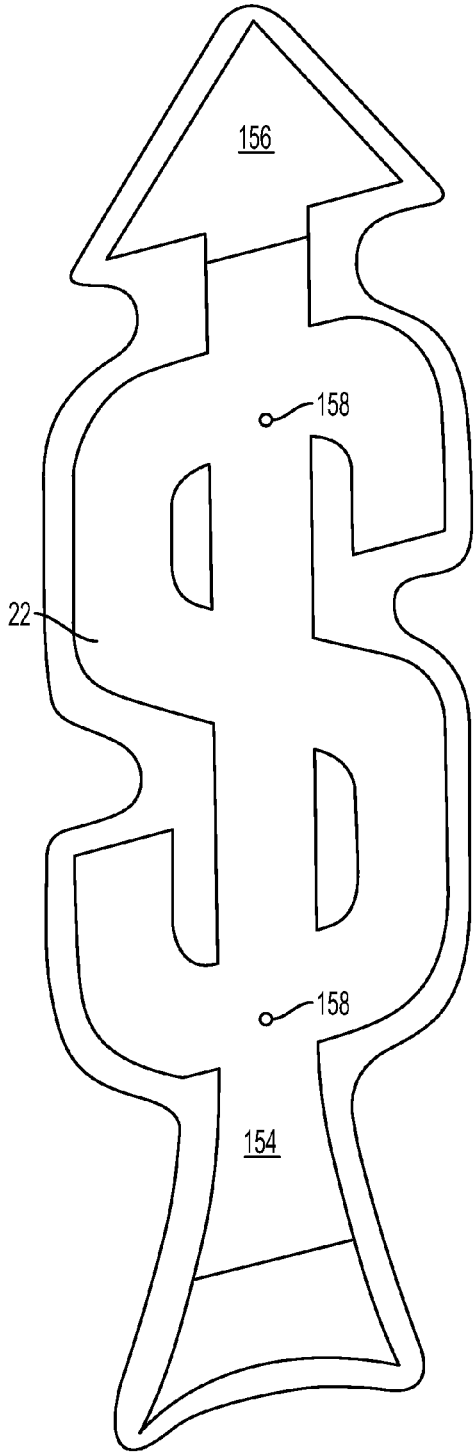
FIGS. 10A-I are top views of various embodiments of the indicator of the spinner of FIG. 1.
Figure 10B:
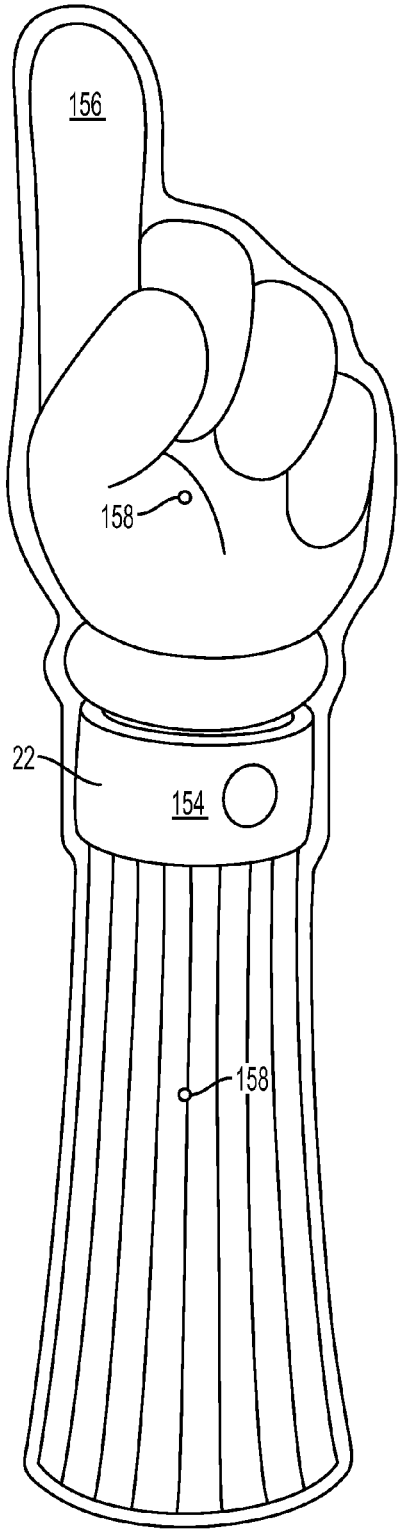
Figure 10C:
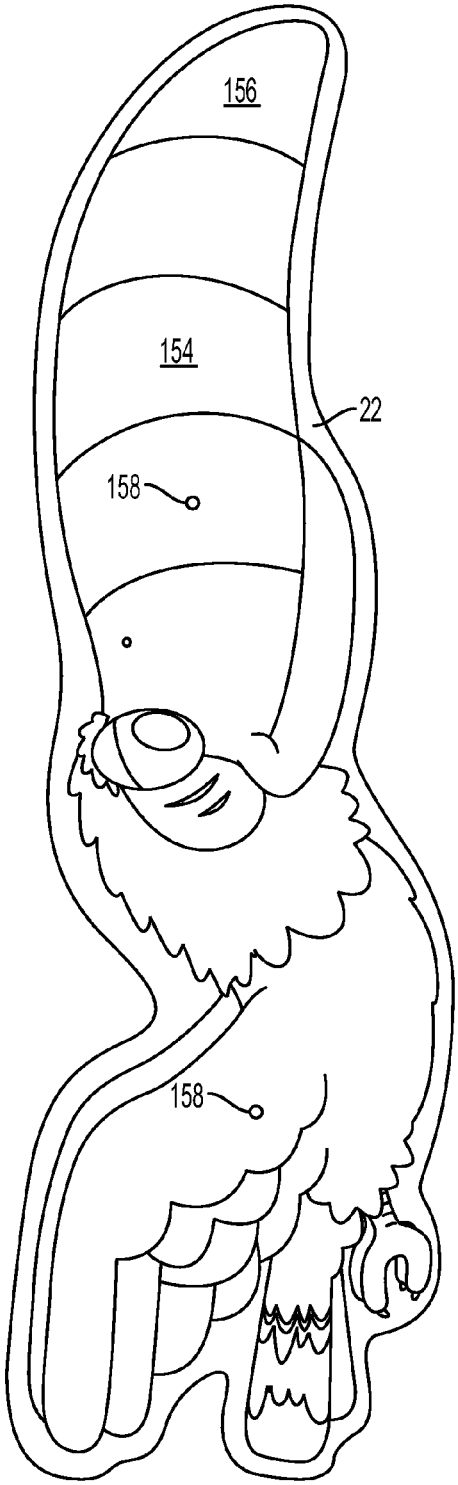
Figure 10D:
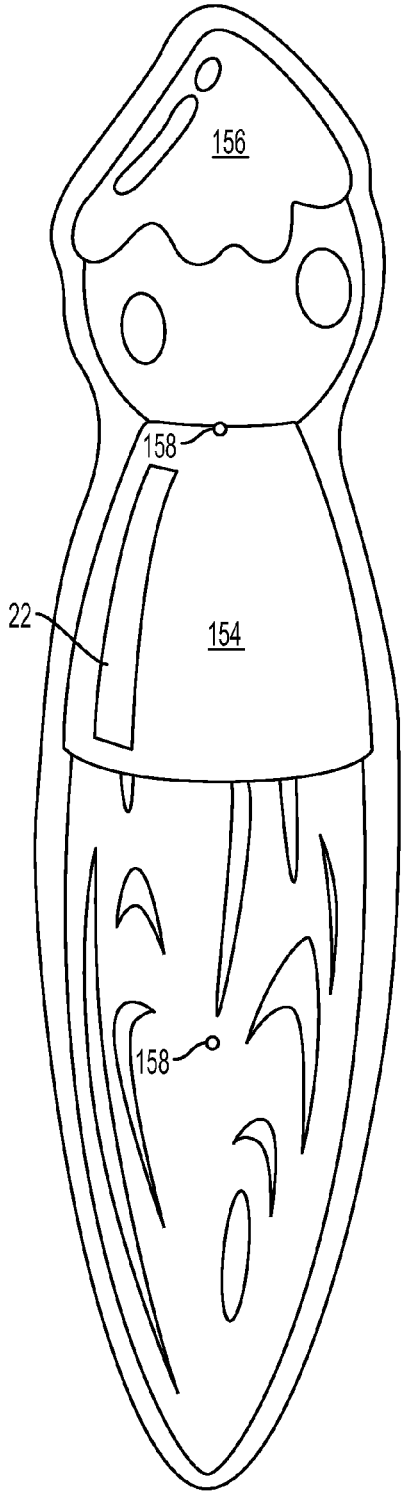
Figure 10E:
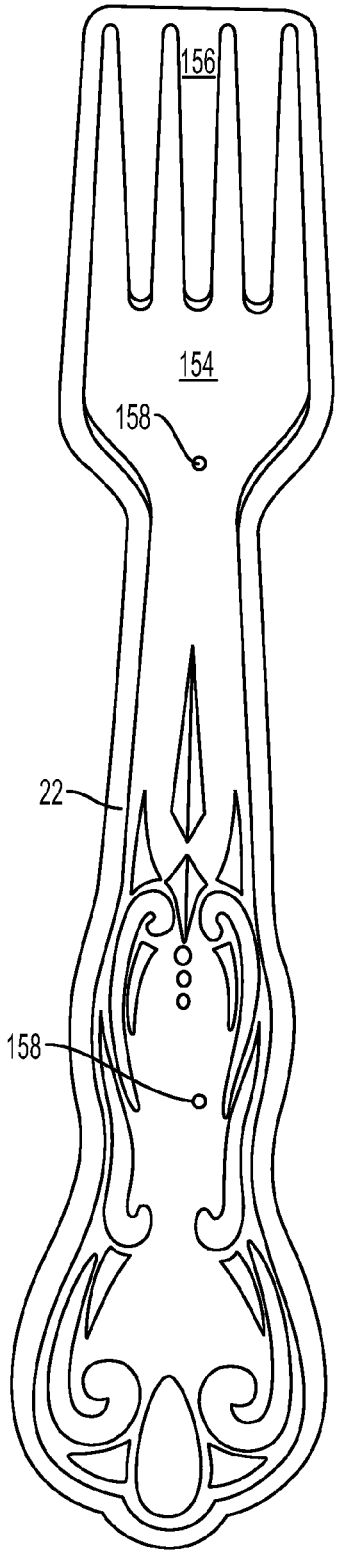
Figure 10F:
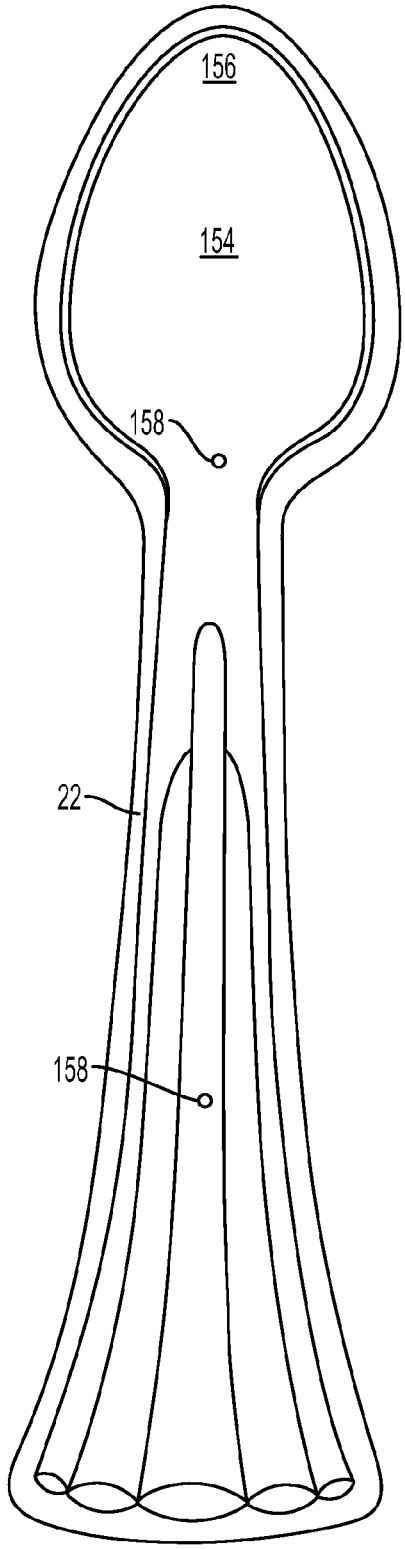
Figure 10G:
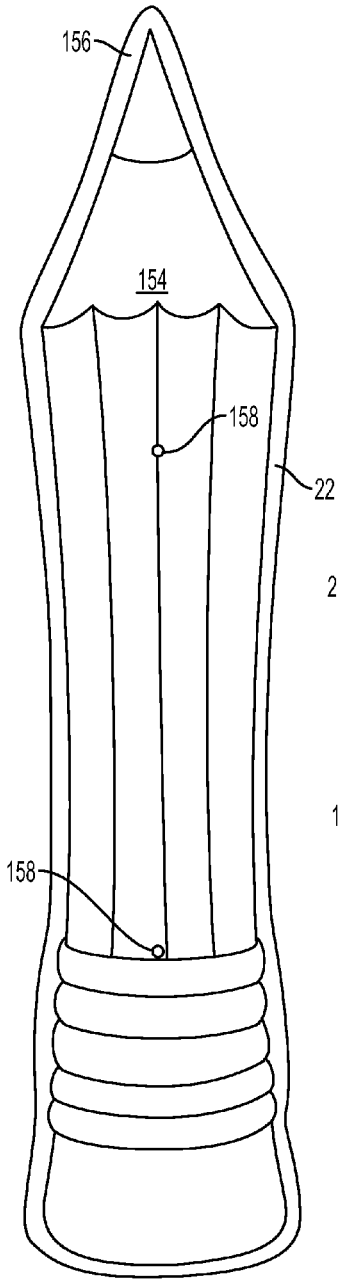
Figure 10H:
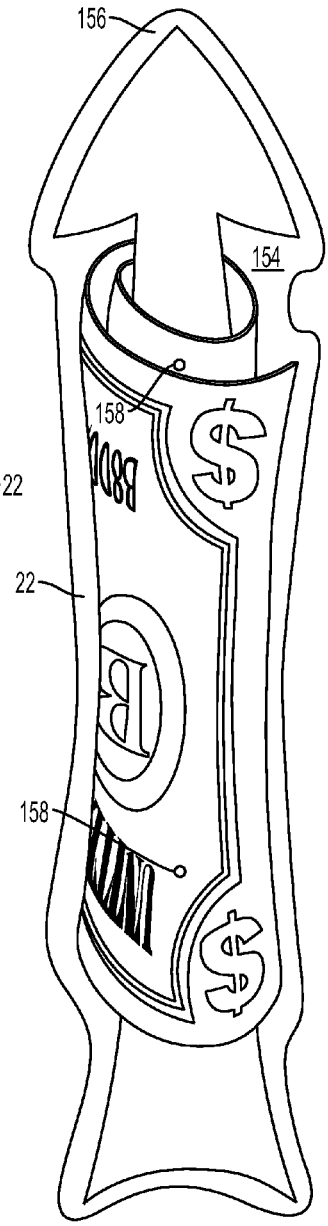
Figure 10I:
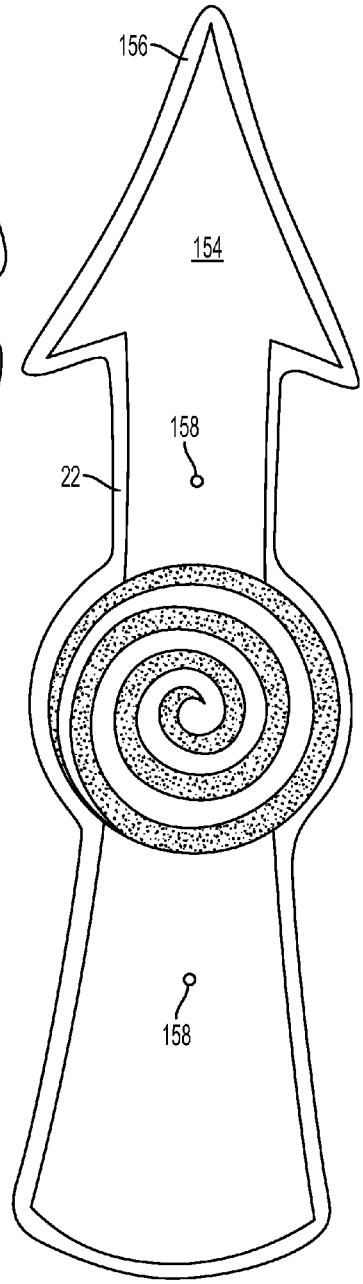

Illustrated in FIGS. 8 and 9, the base 14 of the spinner 10 includes a bottom 26, a top 30 extending axially upwardly from the bottom 26, and a central recess 34 extending through both portions 26, 30. The base 14 is configured to receive at least a portion of a coupling member 32 (e.g., a cylindrical magnet) while pivotably supporting the spinner arm 18. The base 14 provides a stable foundation for the spinner 10. Preferably the coupling member 32 has sufficient contact surface area, weight or holding power to maintain its location with respect to the support surface while the spinner arm 18 is rotationally biased, regardless of orientation (e.g., vertical, horizontal, etc.).

The bottom 26 of the base 14 is substantially cylindrical, defining an upper shoulder 36, an outer annular wall 38 extending axially downwardly from the upper shoulder 36, and an inner annular wall 42 extending axially downwardly from the upper shoulder 36 and located radially inwardly and concentric to the outer annular wall 38 to define a first annular recess 46 therebetween. The outer annular wall 38 defines a first outer diameter 54 and a first bottom surface 56. Similarly, the inner annular wall 42 defines a second bottom surface 62. In the illustrated embodiment that includes a magnetic coupling member 32 in bottom 26, the first and second bottom surfaces 56, 62 do not contact the support surface, but in alternate embodiments the annular walls 38, 42 may extend beyond the coupling member 32 and contact the support surface directly.

The first annular recess 46 is positioned between the outer and inner annular walls 38, 42 and is generally shaped to receive at least a portion of the coupling member 32. The first annular recess 46 may retain the coupling member 32 by use of an adhesive, a press fit, a snap fit, a pin, and the like. Alternatively, the base 14 may be molded around the coupling member 32, leaving exposed at least a portion of the coupling member 32.

Although the illustrated embodiment depicts the bottom 26 shaped to receive a generally cylindrical magnetic coupling member 32 (see FIG. 4), in other embodiments the bottom 26 may be configured to receive or be coupled to other coupling members 32, such as a suction cup, adhesive strips, Velcro, and the like. Additionally, the bottom 26 may include a rubberized coating (not shown) to improve grip with the supporting surface and minimize slippage. Furthermore, the bottom 26 may allow the coupling member 32 to be interchangeable, dependent upon the type, finish, material, and/or orientation of the supporting surface (e.g., a magnet for a whiteboard, a suction cup for a window, and the like).

The top 30 defines a second outer diameter 66. The top 30 is substantially annular and is shaped to be received within a second annular recess 74 (see FIG. 7) of the spinner arm 18 (described below). The top 30 is sized and shaped to restrict radial displacement of the base 14 with respect to the spinner arm 18 while permitting relative rotation therebetween.

The central recess 34 is defined by and extends substantially through the base 14. The central recess 34 provides access for a retention device, illustrated as a screw 150, to pivotably couple the base 14 and spinner arm 18. The central recess 34 includes: a first portion 78 having a first inner diameter 80 and defined substantially by inner annular wall 42; a second portion 82 having a second inner diameter 84 and extending axially upwardly from the first portion 78; a third portion 86 having a third inner diameter 88 extending axially upwardly from the second portion 82; and a fourth portion 90 having a fourth inner diameter 92 extending axially upwardly from the third portion 86. Each of the first-fourth portions 78, 82, 86, 90 extend an axial distance, whereby the sum total of the axial distances is equal to the overall height of the base 14.

Bottom 26 includes an engagement surface 83 (see FIG. 4) partially defining second portion 82 of central recess 34. Engagement surface 83 is configured to restrict the axial movement of the screw 150. The second inner diameter 84 is sized appropriately to provide clearance for a shaft 151 of the screw 150 while retaining the screw head 152. In addition, a washer 153 may be placed between the screw 150 and the engagement surface 83 to better distribute the loads produced from the screw head 152. In alternative embodiments, the central recess 34 can be reconfigured to provide clearance or support for other coupling methods between the spinner arm 18 and the base 14. Furthermore, the central recess 34 may be able to receive at least a portion of an external coupling device (not pictured) such as a suction cup, adhesive strips, hooks, and the like.

The present application illustrates the coupling member 32 as a cylindrical magnet. The magnet is longer than the central recess 34 so that the magnet axially extends slightly beyond the bottom surfaces 56, 62 of the base 14 to contact the support surface. The magnet has sufficient contact surface and magnetic pull or strength to support the weight of the spinner 10 and maintain the spinner's position when the member 32 comes in contact with a support surface oriented vertically, horizontally, or otherwise, and which exhibits magnetic characteristics (e.g., steel, iron). In other embodiments, the magnet may be coated with a layer of high friction material to provide additional stability.

Figure 6:
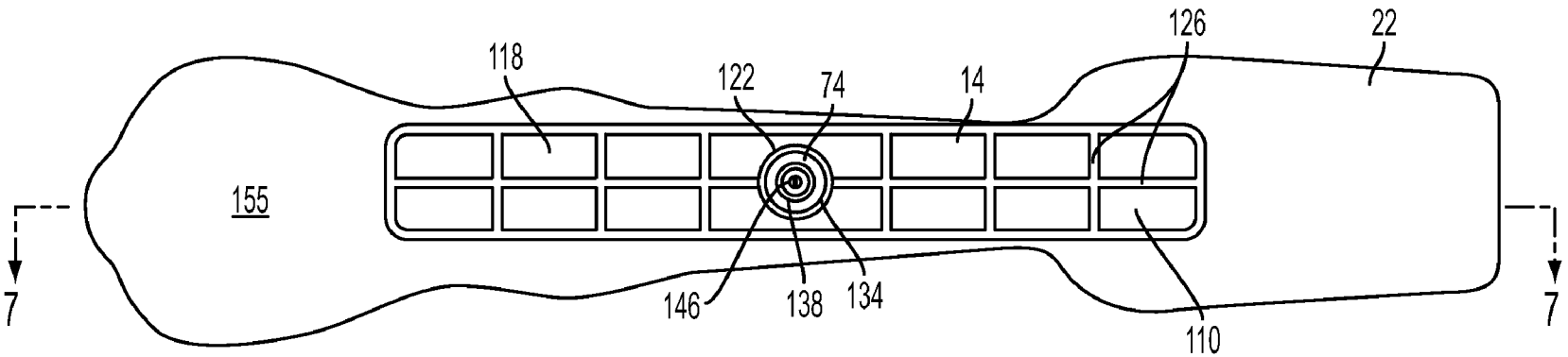
FIG. 6 is a bottom view of a spinner arm and an indicator of the spinner of FIG. 1.
Figure 7:
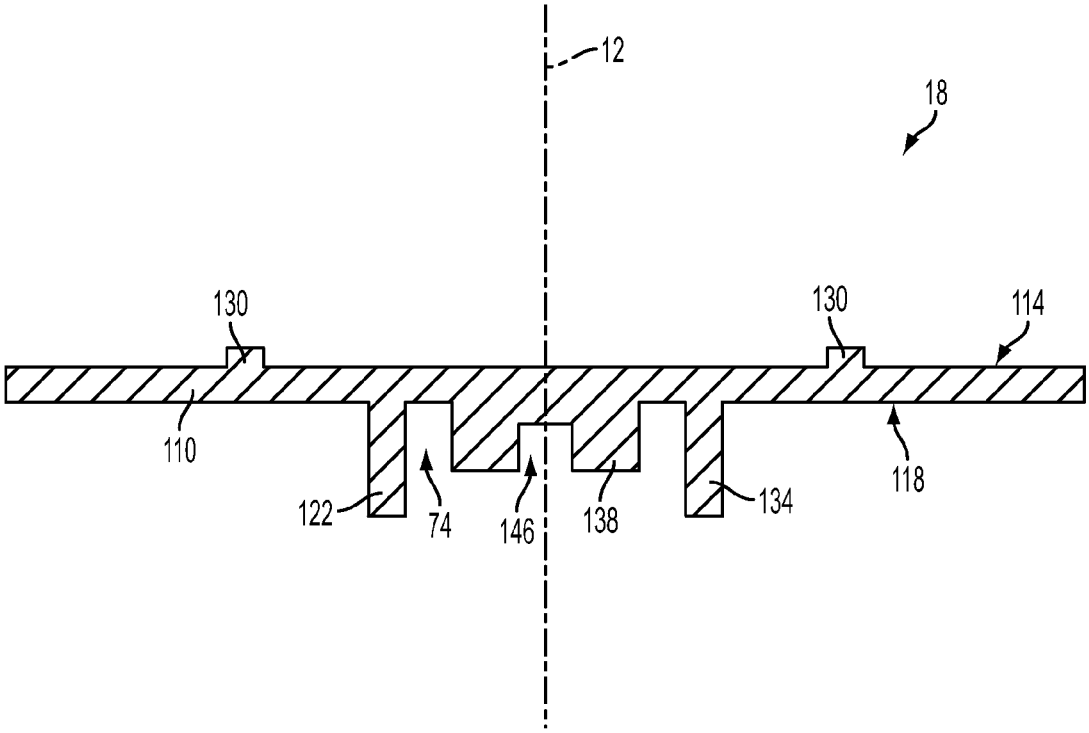
FIG. 7 is a section view of the spinner arm taken along line 7-7 of FIG. 6.

FIGS. 6 and 7 illustrate the spinner arm 18 of the spinner 10. The spinner arm 18 includes an elongated plate 110 having an upper surface 114 and a lower surface 118. The spinner arm 18 also has a pivot boss 122 extending substantially normal to the lower surface 118 to pivotably engage the base 14. The spinner arm 18 provides support and rigidity to the indicator 22 while positioning it with respect to the pivot axis 12.

The upper surface 114 and the lower surface 118 extend a first length. The elongated plate 110 is substantially rectangular, although in other embodiments the elongated member may be shaped to appropriately support the indicator 22 coupled thereto. The elongated plate 110 may further have a plurality of reinforcing ribs 126 for added support and rigidity while minimizing overall weight and material. In the illustrated embodiment, the reinforcing ribs 126 extend along the lower surface 118 and are situated in a substantially gridlike pattern (see FIG. 6).

The upper surface 114 of the elongated plate 110 is substantially planar, providing sufficient surface area and shape to properly support the indicator 22, which has a second length preferably equal to or greater than the first length of the spinner arm 18. The elongated plate 110 also includes a first alignment mechanism, such as a plurality of alignment pins 130 extending substantially normal to the upper surface 114. Each of the plurality of alignment pins 130 corresponds to and can engage with a particular alignment recess 158 (described below) defined by the indicator 22. The alignment pins 130 are positioned such that when received by the plurality of alignment recesses 158, the center of mass of the indicator 22 substantially aligns with axis 12. This alignment assures the spinner arm 18/indicator 22 rotates about the base 14 in balance. The alignment is particularly important when the spinner 10 is coupled to a vertical surface, such as a wall, where being out of balance could result in the spinner 10 coming to rest with the heavier side consistently pointing down.

The pivot boss 122 extends generally normal to the lower surface 118 to define an outer annular wall 134 and an inner annular wall 138 positioned radially inwardly and concentric to the outer annular wall 134, with the second annular recess 74 therebetween. The pivot boss 122 is generally located at the center of mass of the spinner arm 18. In the illustrated embodiment, the second annular recess 74 receives at least a portion of the top 30 to restrict radial displacement between the spinner arm 18 and the base 14 while allowing relative rotation therebetween. The pivot boss 122 may also define a recess 146 defined by the inner annular wall 138 and configured to threadably engage the shaft 151 of the screw 150 to axially secure the base 14 and the spinner arm 18.

FIGS. 10A-10I illustrate various embodiments of the indicator 22. The indicator 22 includes an image surface 154 having an image printed thereupon and a bottom surface 155 and defines a center of mass. The indicator 22 is fixedly coupled to the upper surface 114 of the spinner arm 18, preferably by an adhesive. The indicator 22 may include pointing indicia 156 such as an arrow, finger, and the like located at one end of the indicator 22 to allow for the spinner 10 to "point" at one of a plurality of objects on the support surface. Furthermore, the indicator 22 has an outer perimeter generally corresponding to that of the image depicted on the image surface 154. Moreover, the image on the image surface 154 may relate to a theme, such as money, food, art, math, and the like, such images including but not limited to, an arrow, a dollar sign, a finger, a pencil, and a paintbrush. The indicator 22 also includes a second alignment mechanism, such as a plurality of alignment recesses 158 corresponding to the plurality of alignment pins 130 for proper positioning of the indicator 22 with respect to the base 14.

In other embodiments, the image and the bottom surfaces 154, 155 may both have an image printed thereupon. In such an embodiment, the indicator 22 may be removeably coupled to the spinner arm 18, and as such, may be flipped to display either image dependent upon the current activity. Furthermore, the plurality of alignment pins 130 and alignment recesses 158 may be configured to removeably couple the indicator 22 and the spinner arm 18.

The multi-purpose spinner 10 may be assembled as a unit. During assembly, the pivot boss 122 of the spinner arm 18 receives a portion of the top 30 of the base 14. The screw 150 is combined with the washer 53, and the assembly is axially introduced into the central recess 34 adjacent the bottom surfaces 56, 62. The screw 150 is then threaded into the spinner arm 18, whereby, the spinner arm 18 and base 14 are pivotably coupled.

What is claimed is:

1. A spinner couplable to a support surface, the spinner comprising:

a base defining a central axis;

a spinner arm coupled to and rotatable with respect to the base about the central axis; and a coupling member to removably couple the base to the support surface, the coupling member sufficient to maintain the location of the base on the support surface regardless of the orientation of the central axis or the rotation of the spinner arm;

wherein the spinner arm further includes an indicator coupled thereto; and wherein the indicator defines a center of mass, and the center of mass is substantially co-axial with the central axis.

2. The spinner of claim 1, wherein the coupling member is a magnet.

3. The spinner of claim 1, wherein the spinner arm is coupled to the base by a fastener.

4. The spinner of claim 1, wherein the indicator includes pointing indicia and an image printed thereupon.

5. The spinner of claim 1, wherein the spinner arm further includes one or more alignment pins and the indicator includes one or more alignment recesses each corresponding to a respective alignment pin.

6. The spinner of claim 1, wherein the coupling member has a first length and the base has a recess in which the coupling member is received, the recess having a second length which is less than the first length.

7. A spinner couplable to a support surface, the spinner comprising:

a base defining a central axis;

a coupling member to removably couple the base and the support surface;

a spinner arm coupled to and rotatable with respect to the base about the central axis, the spinner arm including a first alignment mechanism; and an indicator couplable to the spinner arm and defining a center of mass, the indicator including a second alignment mechanism engageable with the first alignment mechanism to position the indicator on the spinner arm such that the center of mass of the indicator when coupled to the spinner arm is substantially co-axial with the central axis.

8. The spinner of claim 7, wherein the indicator includes pointing indicia.

9. The spinner of claim 7, wherein the coupling member is a magnet.

10. The spinner of claim 7, wherein the first alignment mechanism includes one or more alignment pins and the second alignment mechanism includes one or more alignment recesses.

11. The spinner of claim 7 wherein the base has first and second recesses, and wherein the coupling member fits within the recesses.

12. A spinner couplable to a support surface, the spinner comprising:

a base defining a central axis;

a spinner arm coupled to and rotatable with respect to the base about the central axis;

a coupling member to removably couple the base to the support surface, the coupling member sufficient to maintain the location of the base on the support surface regardless of the orientation of the central axis; and an indicator couplable to the spinner arm and defining a center of mass, the indicator coupled to the spinner arm such that the center of mass is substantially co-axial with the central axis.

13. The spinner of claim 12, wherein the coupling member is a magnet.

14. The spinner of claim 12, wherein the spinner arm includes a first alignment mechanism and the indicator includes second alignment mechanism engageable with the first alignment mechanism.

15. The spinner of claim 12, wherein the spinner arm is coupled to the base by a fastener.

16. The spinner arm of claim 12, wherein the indicator has two opposing image-bearing surfaces.

17. The spinner arm of claim 12, wherein the spinner arm has a first length and the indicator has a second length equal to or greater than the first length.

* * * * *